US005445421A

United States Patent [19]

Ferrara

[11] Patent Number: 5,445,421

[45] Date of Patent: Aug. 29, 1995

[54] DUAL THROAT LATCH ASSEMBLY

[75] Inventor: Randy Ferrara, Clinton Township, Mich.

[73] Assignee: General Motors Corporation, Detroit, Mich.

[21] Appl. No.: 130,556

[22] Filed: Oct. 1, 1993

[51] Int. Cl.[6] ..... E05C 3/16

[52] U.S. Cl. ..... 292/216; 292/244; 292/337; 292/DIG. 14

[58] Field of Search ..... 292/216, DIG. 14, 244, 292/341.17, 337, DIG. 43

[56] References Cited

U.S. PATENT DOCUMENTS

| | | | |
|---|---|---|---|
| 119,673 | 10/1871 | Warner et al. | 292/244 X |
| 4,835,997 | 6/1989 | Akright | 70/141 |
| 4,896,907 | 1/1990 | Hayakawa et al. | 292/216 |

FOREIGN PATENT DOCUMENTS 2-232487 9/1990 Japan .

*Primary Examiner*—Rodney M. Lindsey
*Attorney, Agent, or Firm*—Charles E. Leahy

[57] ABSTRACT

According to the invention, a vehicle body has a latch assembly for latching and unlatching a pivotally movable closure panel carrying a striker. The latch assembly has first and second throats for alternately receiving the striker and a latching means adapted for alternate assembly to capture the striker in the first throat and alternately in the second throat. In accordance with the invention, a forkbolt lever is pivotally supported on a housing and is adapted for alternate assembly being mountable for rotation to capture the striker either in the first throat or alternately in the second throat. The detent lever is pivotally supported on a housing and is adapted for alternate assembly being mountable for rotation to selectively engage the forkbolt lever for capturing the striker either in the first throat or alternately in the second throat. The latch assembly may be alternately assembled for releasing the striker and unlatching the hood either by pulling a cable on a left side of the vehicle for a left-hand version or by pulling a cable on a right side of the vehicle for a right-hand version.

14 Claims, 2 Drawing Sheets

DUAL THROAT LATCH ASSEMBLY

The invention relates to a latch assembly for latching and unlatching a hood in a vehicle, and more particularly to an improved latch assembly which can be alternately assembled for unlatching the hood by pulling a cable on either the left or right side of the vehicle.

BACKGROUND OF THE INVENTION

It is well known in motor vehicles to have a hood which carries a striker. It is also well known to have a latch assembly mounted to the vehicle for latching and unlatching the hood. A conventional latch assembly includes a housing having a throat for receiving the striker. Typically, a forkbolt lever is pivotally mounted to the housing for movement between a latched position for capturing the striker in the housing throat to latch the hood and an unlatched position for releasing the striker to unlatch the hood. The latch assembly also typically includes a detent lever for selectively engaging the forkbolt lever in the latched position. A cable is attached to the detent lever and is robted to a hood release handle mounted adjacent a vehicle driver. The driver pulls the handle which pulls the cable causing the detent lever to disengage from the forkbolt lever to release the striker and unlatch the panel.

It is becoming increasingly common in a global economy to produce vehicles having a left-drive version and a right-drive version. A conventional latch assembly can be made in a left-hand version and a right-hand version by manufacturing and assembly of a different housing, forkbolt lever and detent lever. The prior art also recognizes that a housing having a central throat may be used with a left-drive or right-drive vehicle. However, redundant manufacturing operations must be performed to provide duplicate left-hand and right-hand mounting holes on the housing for pivot pins to support the forkbolt lever and detent lever. In addition, a different forkbolt lever and detent lever are typically manufactured and assembled to provide a left-hand or a right-hand version of the latch assembly. The requirement of different components and different or redundant manufacturing and assembly operations adds time and cost to producing latch assemblies.

Thus, it would be desirable to provide an improved latch assembly which utilizes the same housing, pivot pins, detent lever, and forkbolt lever, and which may be alternately assembled for releasing the striker and unlatching the hood either by pulling a cable on a left side of the vehicle for a left-hand version or by pulling a cable on a right side of the vehicle for a right-hand version.

SUMMARY

According to the invention, a vehicle body has a latch assembly for latching and unlatching a pivotally movable closure panel carrying a striker. The latch assembly has first and second throats for alternately receiving the striker and a latching means adapted for alternate assembly to capture the striker in the first throat and alternately in the second throat.

A forkbolt lever is pivotally supported on a housing via a first pivot pin for movement to capture and release the striker. A detent lever is pivotally supported on the housing via a second pivot pin for selectively engaging the forkbolt lever for capturing the striker. The first pivot pin is spaced vertically apart from the second pivot pin, and the housing defines a vertical axis intersecting the pivot axes of the first and second pivot pins. The housing has first and second throats spaced equidistant from opposite sides of the vertical axis. The forkbolt lever is adapted for alternate assembly to rotate on the first pivot pin in one direction to capture the striker in the first throat or alternately to rotate in an opposite direction to capture the striker in the second throat. The detent lever is adapted for alternate assembly by being mountable for rotation to selectively engage the forkbolt lever for capturing the striker either in the first throat or alternately in the second throat. The housing may also include first and second forkbolt spring anchors and first and second detent spring anchors, each pair of anchors spaced equidistant on opposite sides of the vertical axis for alternately anchoring a forkbolt spring and a detent spring, respectively. A release device effects rotation of the detent lever for disengaging from the forkbolt lever such that the striker is either released from the first throat or alternately from the second throat to unlatch the panel. The release device is preferably a cable which may be pulled on either a left vehicle side or right vehicle side to unlatch the panel.

Accordingly, it is an object, feature, and advantage of this invention to provide an improved latch assembly which may be assembled either for releasing the striker from the first throat to unlatch the panel by pulling a cable on the left vehicle side or alternately for releasing the striker from the second throat to unlatch the panel by pulling a cable on the right vehicle side.

It is also an object of this invention to provide an improved latch assembly which utilizes the same housing, pivot pins, forkbolt lever, detent lever, forkbolt spring, and detent spring for either capturing the striker in the first throat or alternately in the second throat thereby reducing and simplifying manufacturing and assembly operations.

BRIEF DESCRIPTION OF THE DRAWINGS

These and other features, objects and advantages of the present invention will become apparent upon consideration of the following description, appended claims, and accompanying drawings in which:

DESCRIPTION OF THE PREFERRED EMBODIMENT

Figure 1:
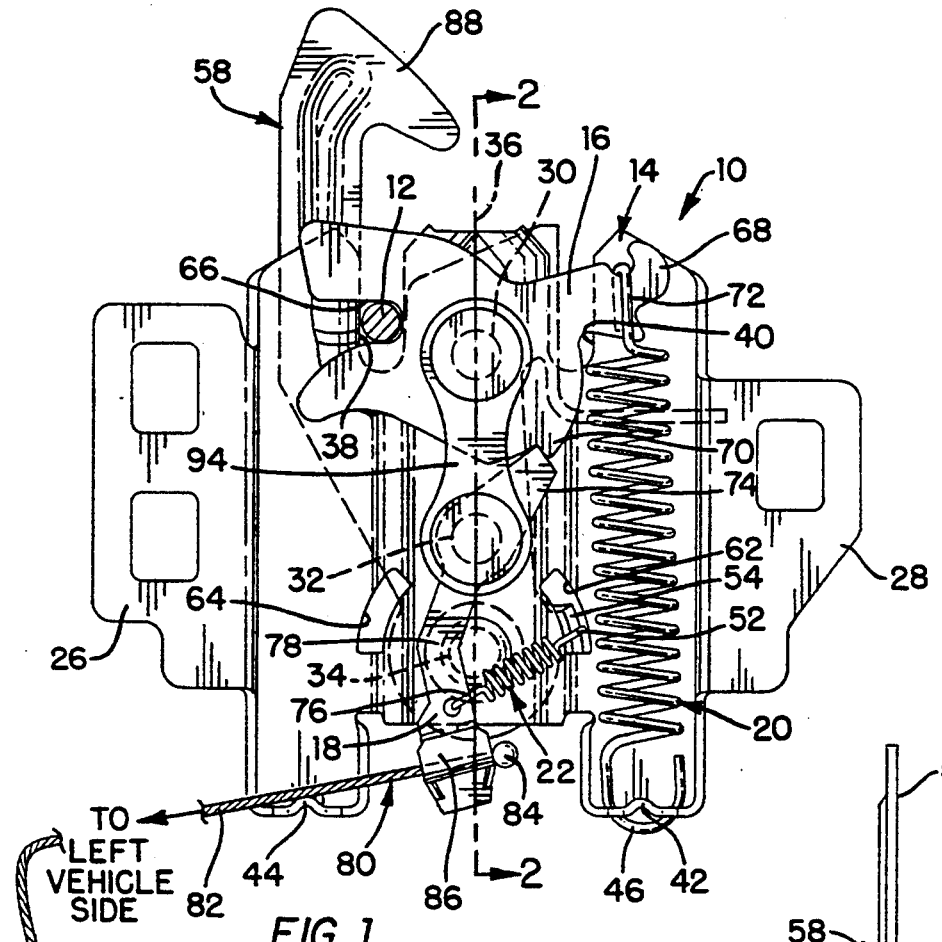
FIG. 1 is a rear view of the latch assembly shown in the latched position and assembled for capturing the striker in a first throat such that the hood is unlatched by pulling a cable on a left side of the vehicle.
Figure 2:
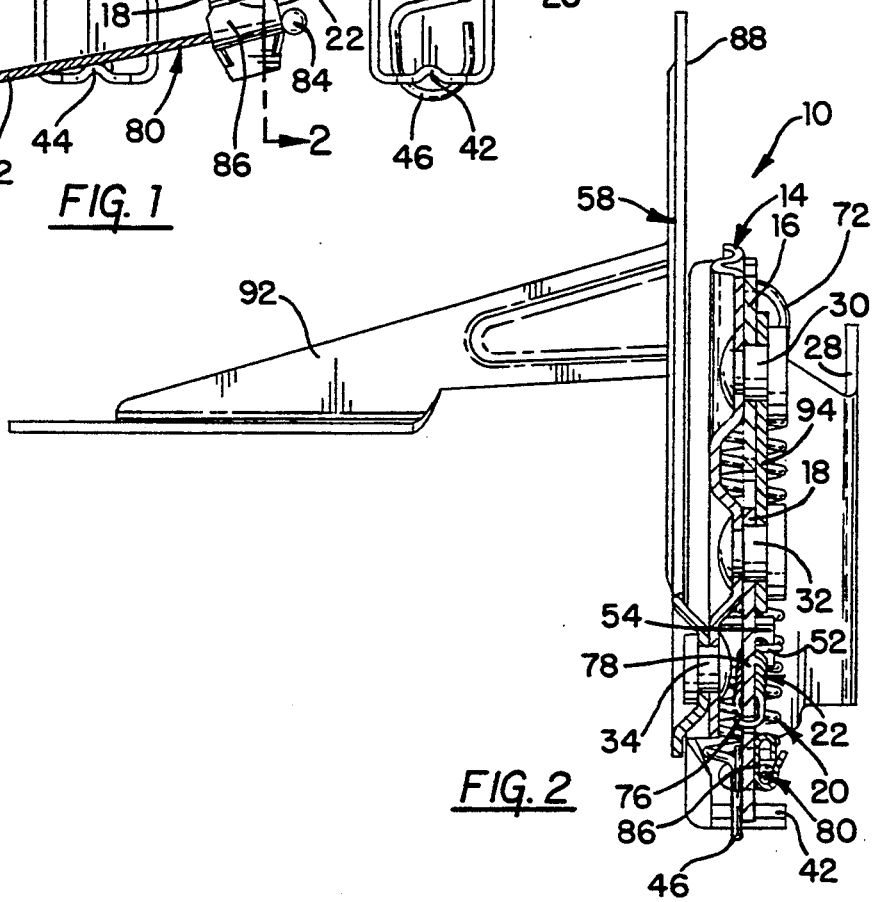
FIG. 2 is a cross-sectional view of the latch assembly taken as indicated by line 2—2 of FIG. 1.

FIGS. 1 and 2 show a latch assembly 10 capturing a striker 12 carried by the underside of a pivotally movable closure panel, such as a hood (not shown) in a left-drive vehicle. The latch assembly 10 underlies the hood and includes a housing 14 adapted for supporting a forkbolt lever 16, a detent lever 18, a forkbolt spring 20, a detent spring 22, and a left-hand secondary latch element 58 which function cooperatively to enable capture of the striker 12 in a first throat 38 on the housing 14 to latch the hood. The hood is unlatched by pulling a cable 82 routed to the latch assembly 10 from the left side of the vehicle adjacent a left-side driver.

The latch assembly 10 includes a vertically disposed housing 14 for mounting to the vehicle by fasteners, such as bolts (not shown), extending through transversely extending mounting flanges 26, 28.

The forkbolt lever 16 has a recessed portion 66 shaped for capturing the striker 12, a hook-shaped portion 68, and a downwardly extending stepped portion 70. The forkbolt lever 16 is pivotally supported on the housing 14 by a first pivot pin 30 for movement between a latched position for capturing the striker 12, as shown in FIG. 1, and an unlatched position for releasing the striker 12. The forkbolt lever 16 is spring biased for clockwise rotation towards the unlatched position by a coiled forkbolt spring 20 having an upper end 72 attached to the hook-shaped portion 68 of the forkbolt lever 16 and a lower end 46 attached to a first forkbolt spring anchor 42 rearwardly protruding from the housing 14.

The detent lever 18 is pivotally supported on the housing 14 by a second pivot pin 32. An upper portion 74 of the detent lever 18 is shaped for selectively engaging the stepped portion 70 on the forkbolt lever 16 for maintaining the forkbolt lever 16 in the latched position. The detent lever 18 is biased for counterclockwise rotation towards engaging the forkbolt lever by a coiled detent spring 22 having a lower end 76 attached to the detent lever 18 and an upper end 52 attached to a first detent spring anchor 54 carried by the left-hand secondary latch element 58 and extending rearwardly through a first opening 62 in the housing 14.

A bearing plate 94 partially overlies the forkbolt lever 16 and detent lever 18 to stabilize their pivotal movement about the first and second pivot pins 30, 32.

A cable release device 80 includes a cable 82 which is connected at one end 84 by a clip 86 to a downwardly extending leg 78 of the detent lever 18 and at the other end to a handle 50 adjacent a left-side vehicle driver. The cable 82 is routed from the driver, through the left side of the vehicle to the left side of the latch assembly 10 for attachment to the detent lever 18.

Referring to FIGS. 1 and 2, the hood is unlatched by the left-side driver pulling the handle 50 to pull the cable 82 leftwardly which overcomes the bias of the detent spring 22 and rotates the detent lever 18 clockwise such that the upper portion 74 disengages from the stepped portion 70 of the forkbolt lever 16. The forkbolt lever 16 is freed for clockwise rotation as biased by the forkbolt spring 20 so that the forkbolt lever 16 lifts the striker 12 upwardly out of the first throat 38 thereby releasing the striker 12 and unlatching the hood.

The left-hand secondary latch element 58, is pivotally supported on the housing 14 by a third pivot pin 34 and includes an upper hooked end 88 vertically overlying the striker 12 to limit upward pivotal movement of the unlatched hood. As best shown in FIG. 2, a forwardly extending arm 92 is manually manipulable for moving the upper end 88 out of the path of the striker 12 to permit the continuing upward pivotal movement of the unlatched hood.

Figure 3:
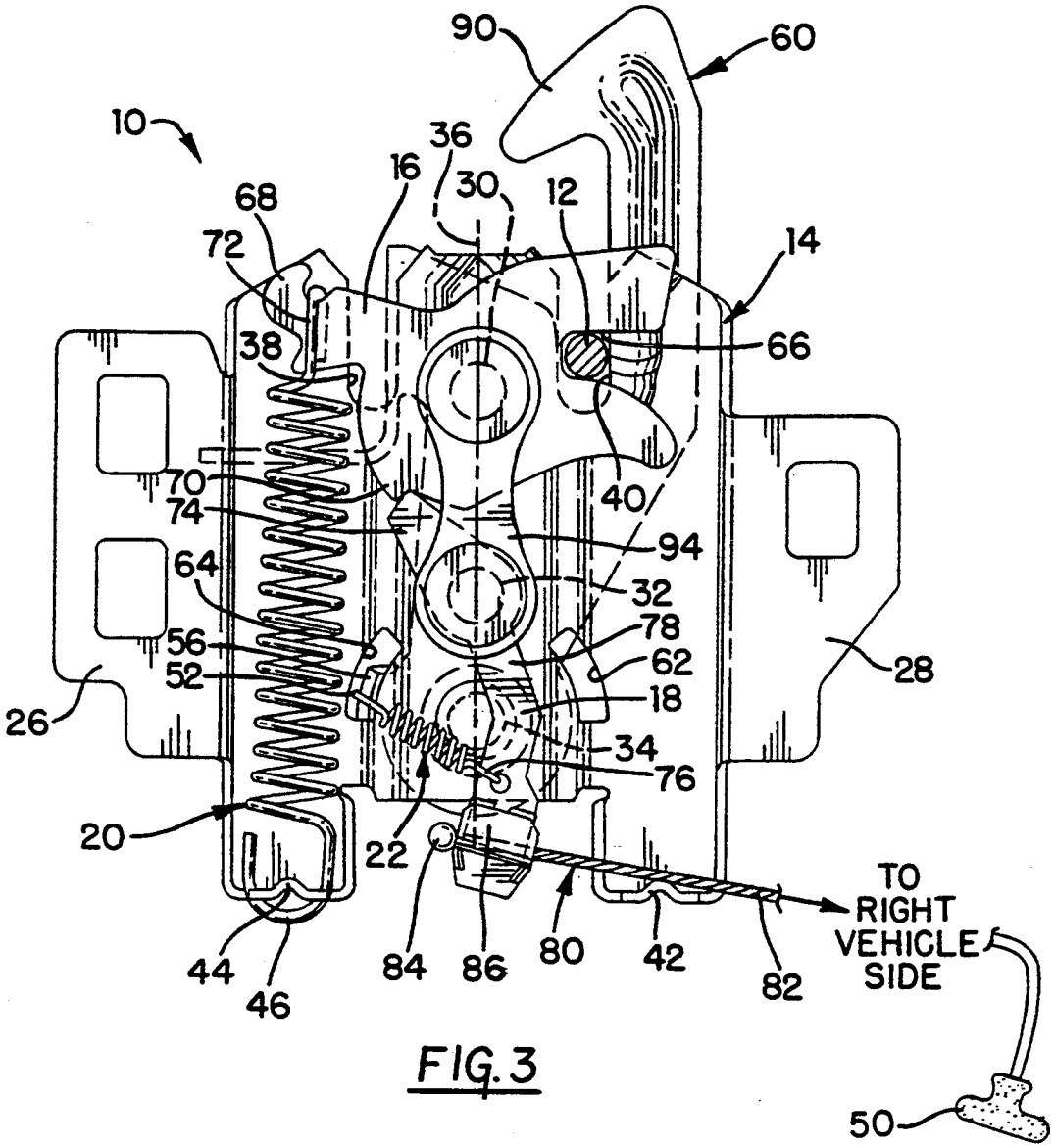
FIG. 3 is a view similar to FIG. 1 showing the latch assembly in the latched position and assembled for capturing the striker in a second throat such that the panel is unlatched by pulling a cable on a right side of the vehicle.

FIG. 3 shows the latch assembly 10 alternately assembled for use in a right-drive vehicle such that the forkbolt lever 16, detent lever 18, forkbolt spring 20, detent spring 22, and right-hand secondary latch element 60 cooperatively capture the striker 12 in a second throat 38 on the housing 14 to latch the hood.

The hood is unlatched by a right-side driver pulling the handle 50 to pull the cable 82 rightwardly which overcomes the bias of the detent spring 22 and rotates the detent lever 18 counterclockwise such that the upper portion 74 disengages from the stepped portion 70 of the forkbolt lever 16. The forkbolt lever 16 is freed for counterclockwise rotation as biased by the forkbolt spring 20 so that the forkbolt lever 16 lifts the striker 12 upwardly out of the second throat 40 thereby releasing the striker 12 and unlatching the hood.

The latch assembly 10 has unique structural features which enable alternate assembly to provide a latch assembly 10 for a left-drive or right-drive vehicle.

Particular to the present invention, FIGS. 1 and 3 show that the first pivot pin is spaced vertically above the second pivot pin 32 which is spaced vertically above the third pivot pin 34. The housing 14 defines a vertical axis 36 which intersects the longitudinally extending pivot axes of the first, second, and third pivot pins 30, 32, 34. The first and second throats 38, 40 on the housing are spaced equidistant from opposite sides of the vertical axis 36 for alternately receiving the striker 12. The striker 12 is mounted on the hood for alignment with the first throat 38 in a left-drive vehicle and for alignment with the second throat 40 in a right-drive vehicle.

The housing 14 also includes first and second forkbolt spring anchors 42, 44 which are spaced equidistant from opposite sides of the vertical axis 36 for alternately anchoring the lower end 46 of the forkbolt spring 20. The housing 14 further includes first and second openings 62, 64 which are spaced equidistant from opposite sides of the vertical axis 36 for alternately receiving rearwardly extending first and second detent spring anchors 54, 56 carried by the right-hand and left-hand secondary latch elements 58, 60, respectively, for alternately anchoring the upper end 52 of the detent spring 22.

It will be appreciated that the housing 14 is similarly mounted to the vehicle for use in either a left-drive or right-drive vehicle. It will further be appreciated that manufacturing and assembly operations are reduced and simplified since the same housing 14 with the same pivot pins 30, 32, 34 are utilized with the same forkbolt lever 16, detent lever 18, forkbolt spring 20 and detent spring 22 for both the left-hand and right-hand version of the latch assembly 10. Furthermore, the forkbolt lever 16, detent lever 18, forkbolt spring 20, and detent spring 22 are easily alternately assembled to the housing 14 to provide either a left-hand or right-hand latch assembly 10 simply by being mounted for rotation in an opposite direction as enabled by the vertically aligned first and second pivot pins 30, 32. The forkbolt lever 16 and detent lever 18 are preferably flat planar metal stampings which coplanarly align when assembled to further enable their alternative assembly.

Thus, the present invention provides an improved latch assembly 10 which may be alternately assembled either for releasing the striker 12 from the first throat 38 to unlatch the hood by pulling the cable 82 on the left vehicle side for a left-hand version or for releasing the striker 12 from the second throat 40 to unlatch the hood by pulling the cable 82 on a right vehicle side for a right-hand version.

It will be understood that a person skilled in the art may make modifications to the preferred embodiment shown herein within the scope and intent of the claims. For example, although the preferred embodiment has been described for use as a latch assembly for a hood, it will be understood that the same latch assembly could be used in conjunction with other vehicle panels such as deck lids and tailgates. As another example, it will further be understood that although the preferred embodiment includes a coiled forkbolt spring 20 and a coiled detent spring 22, other biasing devices are equally applicable. As a further example, although the preferred embodiment includes a cable release device 80, any other suitable mechanical release device which effects rotational movement of the detent lever 18 will be equally applicable.

While the present invention has been described as carried out in a specific embodiment thereof, it is not intended to be limited thereby but is intended to cover the invention broadly within the scope and spirit of the appended claims.

The embodiments of the invention in which an exclusive property or privilege is claimed are defined as follows:

1. In a latch assembly for latching and unlatching a pivotally movable closure panel carrying a striker, the latch assembly having a forkbolt lever pivotally supported on a housing via a first pivot means for movement between a latched position for capturing the striker and an unlatched position for releasing the striker, and a detent lever pivotally supported on the housing via a second pivot means for selectively engaging the forkbolt lever in the latched position, the improvement comprising:

the housing having a housing axis intersecting the pivot axes of the first and second pivot means, the housing having first and second throats for alternately receiving the striker, the first and second throats spaced equidistant on opposite sides of the housing axis;

the forkbolt lever being mountable for rotation in a first forkbolt direction to capture the striker in the first throat and alternately mountable for rotation in a second forkbolt direction to capture the striker in the second throat;

and the detent lever being mountable for rotation in a first detent direction to engage the forkbolt lever for capturing the striker in the first throat and alternately mountable for rotation in a second detent direction to engage the forkbolt lever for capturing the striker in the second throat;

whereby the latch assembly may be alternately assembled to capture the striker in either one of the first or second throats to latch the closure panel.

2. In a latch assembly for latching and unlatching a pivotally movable closure panel carrying a striker, the latch assembly having a forkbolt lever pivotally supported on a housing via a first pivot means for movement between a latched position for capturing the striker and an unlatched position for releasing the striker, and a detent lever pivotally supported on the housing via a second pivot means for selectively engaging the forkbolt lever in the latched position, the improvement comprising:

the first pivot means spaced vertically apart from the second pivot means, the housing having a vertical axis intersecting the pivot axes of the first and second pivot means, the housing having first and second throats for alternately receiving the striker, the first and second throats spaced equidistant on opposite sides of the vertical axis, the forkbolt lever being mountable for rotation in a first forkbolt direction to capture the striker in the first throat and alternately mountable for rotation in a second forkbolt direction to capture the striker in the second throat, and the detent lever being mountable for rotation in a first detent direction to engage the forkbolt lever for capturing the striker in the first throat and alternately mountable for rotation in a second detent direction to engage the forkbolt lever for capturing the striker in the second throat, whereby the latch assembly may be alternately assembled to capture the striker in either one of the first or second throats to latch the closure panel.

3. The improvement of claim 2 further characterized by having a release means operatively connected with the detent lever for effecting rotation of the detent lever opposite the first detent direction to disengage the forkbolt lever such that the striker is released from the first throat and alternately for effecting rotation of the detent lever opposite the second detent direction to disengage the forkbolt lever such that the striker is released from the second throat whereby the striker is released from either the first or second throat and the closure panel is unlatched.

4. The improvement of claim 3 further characterized by the release means including a cable operable by pulling the cable in a first direction for effecting rotation of the detent lever opposite the first detent direction and alternately operable by pulling the cable in a second direction opposite the first direction for effecting rotation of the detent lever opposite the second detent direction such that the closure panel may be unlatched by pulling the cable in either the first direction or second direction.

5. The improvement of claim 2 further characterized by the forkbolt lever and the detent lever being flat planar stampings to enable their coplanar alignment.

6. In latch assembly for latching and unlatching a pivotally movable closure panel carrying a striker, the latch assembly having a forkbolt lever pivotally supported on a housing via a first pivot means for movement between a latched position for capturing the striker and an unlatched position for releasing the striker, a forkbolt spring means for biasing the forkbolt lever towards the unlatched position, and a detent lever pivotally supported on the housing via a second pivot means for selectively engaging the forkbolt lever in the latched position, the improvement comprising:

the first pivot means spaced vertically apart from the second pivot means, the housing having a vertical axis intersecting the pivot axes of the first and second pivot means, the housing having first and second throats for alternately receiving the striker, the first and second throats spaced equidistant from opposite sides of the vertical axis, the forkbolt lever being mountable for rotation in a first forkbolt direction to capture the striker in the first throat and alternately mountable for rotation in a second forkbolt direction to capture the striker in the second throat, first and second forkbolt spring anchors spaced equidistant on opposite sides of the vertical axis for alternately anchoring the forkbolt spring means, the forkbolt spring means being anchorable by the first forkbolt spring anchor for biasing the forkbolt lever towards the unlatched position to release the striker from the first throat and alternately anchorable by the second forkbolt spring anchor for biasing the forkbolt lever towards the unlatched position to release the striker from the second throat, and the detent lever being mountable for rotation in a first detent direction to engage the forkbolt lever for capturing the striker in the first throat and alternately mountable for rotation in a second detent direction to engage the forkbolt lever for capturing the striker in the second throat, whereby the latch assembly may be alternately assembled to capture the striker in either one of the first or second throats to latch the closure panel.

7. The improvement of claim 6 further characterized by having a release means operatively connected with the detent lever for effecting rotation of the detent lever opposite the first detent direction to disengage the forkbolt lever such that the striker is released from the first throat and alternately for effecting rotation of the detent lever opposite the second detent direction to disengage the forkbolt lever such that the striker is released from the second throat whereby the striker is released from either the first or second throat and the closure panel is unlatched.

8. The improvement of claim 7 further characterized by the release means including a cable operable by pulling the cable in a first direction for effecting rotation of the detent lever opposite the first detent direction and alternately operable by pulling the cable in a second direction opposite the first direction for effecting rotation of the detent lever opposite the second detent direction such that the closure panel may be unlatched by pulling the cable either the first direction or second direction.

9. The improvement of claim 6 further characterized by the forkbolt lever and the detent lever being flat planar stampings to enable their coplanar alignment.

10. The improvement of claim 6 further characterized by having a detent spring means for biasing the detent lever towards engaging the forkbolt lever, first and second detent spring anchors spaced equidistant on opposite sides of the vertical axis, and the detent spring means being anchorable by the first detent spring anchor for biasing the detent lever towards the first detent direction for engaging the forkbolt lever to capture the striker in the first throat and the detent spring means being alternately anchorable by the second detent spring anchor for biasing the detent lever towards the second detent direction for engaging the forkbolt lever to capture the striker in the second throat.

11. The improvement of claim 10 further characterized by having a release means operatively connected with the detent lever for effecting rotation of the detent lever opposite the first detent direction to disengage the forkbolt lever such that the striker is released from the first throat and alternately for effecting rotation of the detent lever opposite the second detent direction to disengage the forkbolt lever such that the striker is released from the second throat whereby the striker is released from either the first or second throat and the closure panel is unlatched.

12. The improvement of claim 11 further characterized by the release means including a cable operable by pulling the cable in a first direction for effecting rotation of the detent lever opposite the first detent direction and alternately operable by pulling the cable in a second direction opposite the first direction for effecting rotation of the detent lever opposite the second detent direction such that the closure panel may be unlatched by pulling the cable in either the first direction or second direction.

13. The improvement of claim 10 further characterized by the forkbolt lever and the detent lever being flat planar stampings to enable their coplanar alignment.

14. The improvement of claim 10 further characterized by the housing having first and second openings spaced equidistant on opposite sides of the vertical axis for alternately receiving either the first detent spring anchor through the first opening or the second detent spring anchor through the second opening.

* * * * *